United States Patent [19]

Terry

[11] 4,135,578

[45] Jan. 23, 1979

[54] METHOD OF PREPARING A WET COAL SEAM FOR PRODUCTION IN SITU

[75] Inventor: Ruel C. Terry, Denver, Colo.

[73] Assignee: In Situ Technology, Inc., Denver, Colo.

[21] Appl. No.: 870,865

[22] Filed: Jan. 20, 1978

Related U.S. Application Data

[60] Continuation-in-part of Ser. No. 744,258, Nov. 23, 1976, Pat. No. 4,093,025, which is a division of Ser. No. 595,335, Jul. 14, 1975, Pat. No. 4,069,868.

[51] Int. Cl.[2] ..... E21B 43/24

[52] U.S. Cl. ..... 166/245; 166/251

[58] Field of Search ..... 166/245, 251, 256, 272; 48/DIG. 6

[56] References Cited

U.S. PATENT DOCUMENTS

| | | | |
|---|---|---|---|
| 2,923,535 | 2/1960 | Ljungstrom | 166/256 |
| 2,973,811 | 3/1961 | Rogers | 166/251 |
| 3,016,953 | 1/1962 | Marx | 166/245 |
| 3,115,928 | 12/1963 | Campion et al. | 166/259 |
| 3,152,638 | 10/1964 | Geffen et al. | 166/245 |
| 3,334,687 | 8/1967 | Parker | 166/245 |
| 3,517,744 | 6/1970 | Horton | 166/245 |
| 3,997,005 | 12/1976 | Komar | 166/251 |
| 4,010,800 | 3/1977 | Terry | 48/DIG. 6 |
| 4,024,914 | 5/1977 | Kreinin | 166/251 |
| 4,062,404 | 12/1977 | Pasini et al. | 166/251 X |

FOREIGN PATENT DOCUMENTS

| | | | |
|---|---|---|---|
| 697189 | 9/1953 | United Kingdom | 166/259 |
| 756582 | 9/1956 | United Kingdom | 166/256 |

*Primary Examiner*—Stephen J. Novosad
*Assistant Examiner*—George A. Suchfield

[57] ABSTRACT

A water bearing underground coal seam is prepared for production by in situ techniques by drilling a series of wells into the seam. Paths of maximum permeability are determined by taking oriented cores in selected wells. The coal seam is partially dewatered by removing water from the seam in selected wells. Reaction zones are established in the coal, first along the paths of maximum permeability, then reaction zones are established substantially perpendicular to the original paths of maximum permeability.

7 Claims, No Drawings

METHOD OF PREPARING A WET COAL SEAM FOR PRODUCTION IN SITU

This application is a continuation-in-part application of Ser. No. 744,258 filed Nov. 23, 1976 now U.S. Pat. No. 4,093,025, a divisional application of Ser. No. 595,335, filed July 14, 1975 now U.S. Pat. No. 4,069,868, the disclosures of which are incorporated herein by reference.

BACKGROUND OF INVENTION

This invention relates to the production of coal in situ, wherein a series of wells is drilled into an underground coal seam. More particularly the invention relates to determining the paths of maximum permeability within the coal by recovering oriented cores, partially dewatering the coal by selectively removing the water by removal to the surface of the earth, then establishing reaction zones in the coal.

Production of coal in situ is a well known art, having been practiced experimentally in the United States and many other countries of the world, and having been practiced commercially in Russia. With a rather considerable amount of data generated from the various in situ coal projects, common problems that require solutions are relatively easy to define.

Since it is imperative that fluids be made to flow through the coal seam, effective permeability of coal is an important consideration. All coals have a measure of permeability with the maximum permeability being along the cracks and fissures within the coal seam. Coal, being a non-homogeneous rock, may or may not have predictable patterns of permeability. Existing patterns of permeability may be determined by the cut-and-try methods of drilling a series of wells into the coal seam, then injecting fluids under pressure selectively between pairs of wells to determine which wells have natural linkages. An improvement over these methods is described in the present invention.

Coal seams located above the natural water table underground and generally classified as dry seams whose water content is substantially limited to the chemically combined water within the coal itself. Coal seams located below the natural water table underground generally are classified as wet seams, although in some cases the coal itself may be relatively dry of free water. Such seams can be converted into true wet seams by the simple expedient of innerconnecting the seam to an overlying aquifer. Many coal seams are natural aquifers, with the water charge source being at an outcrop of the seam. Coal seams that are aquifers are good candidates for production using in situ techniques because by being an aquifer the particular seam has demonstrated permeability, otherwise water could not percolate through the seam.

It is desirable that a coal seam selected for in situ production be a wet seam. Free water in the seam provides a hydraulic seal against the escape of gases generated by in situ techniques. Free water in the seam also provides a safety measure to preclude the possibility of runaway burns underground. While free water is an advantage for in situ techniques, control of free water into the underground reaction zone is required. The reaction zone is established in the underground coal by setting the coal afire and propagating the fire by controlled injections of a suitable oxidizer, then withdrawing the products of the reactions to surface facilities. Initial ignition of the coal is difficult if considerable free water is present. Then after ignition, if considerable free water is present, efficiencies of in situ techniques are seriously impaired by the amount of heat required to convert the water to vapor so that it may be removed along with other products generated by in situ processes.

One approach to the water problem underground is described in U.S. Pat. No. 2,973,811 of Rogers, wherein methods are taught to locate the water in an underground carbonaceous deposit by using electrical resistivity surveys. Once the water is located and mapped, plans are made to drive the water out of that portion of the carbonaceous stratum where it is desired to engage in combustion in situ. The water then is displaced by injecting a gas such as air, such displacement forcing the water radially outward from the injection well bore. Such displacement, and the maintenance of the water in its displaced location, requires considerable increase in the normal formation pressure. Such procedures also require a considerable amount of competent overburden to avoid ruptures to the surface of the ground and the consequent loss of hermetic seal required for in situ techniques.

Another approach to the water problem underground is taught in United Kingdom Patent No. 697,189 of Williams. Methods are taught for use in a steeply dipping coal bed wherein two shafts are sunk to the coal seam and the shafts are interconnected with a horizontal channel serving as a reaction zone in the coal. Water is pumped continuously through the shafts to the surface of the earth during ignition and during combustion until a substantial amount of coal is consumed. To minimize the oxygen by-pass problem of greatly enlarged underground channels, the pumping action is slackened off to allow the water table to rise through the accumulated ash and rubble to plug a portion of the underground channel to the flow of gases. Such an arrangement requires a considerable amount of underground workings and requires pumping of water from the reaction zone itself.

Improvements over the methods of the prior art can be made in the case of determining the paths of permeability in the coal by taking oriented cores of the coal for inspection above ground, and in the case of water control by drawing down the water table in the immediate vicinity of the reaction zone rather than limiting the drawdown to the reaction zone itself. It is an object of the present invention to teach such improvements. Other objects, capabilities and advantages of the present invention will become apparent as the description proceeds.

DESCRIPTION OF THE PREFERRED EMBODIMENT

The methods of the present invention begin with the selection of a wet coal seam that appears suitable for production in situ. A tentative well pattern is then selected, for example, a conventional five spot pattern that is repeated throughout the area to be produced. Tentative well spacing is selected, for example 150 feet between wells, generally within the range between 70 feet and 300 feet. A representative portion of the wells are then staked and drilled into the underground coal seam. The representative portion of the wells could be, for example, every twentieth well in the selected pattern, such wells being sometimes called evaluation wells. All wells preferably are completed with casing in the well bore so that hermetic seals can be attained.

The purpose of the evaluation wells is to obtain useful information about the overburden and the coal deposit without having to drill all of the wells in the selected well pattern used for production. Preferably the evaluation wells will be drilled and completed in such a manner that they may be used as production wells later in the production program. Wells used in production should be suitably equipped to permit injection of fluids into the coal seam and to withdraw products of reaction from the reaction zone.

During the course of drilling the evaluation wells it is desirable to take cores in the overburden immediately above the coal seam. Such cores are then examined and tested with the resulting data used to predict expected roof falls and subsidence. When the evaluation well reaches the coal seam it is preferable that oriented cores be taken through the coal seam. Such cores are then examined and tested, with the resulting data used to determine the prevailing directions of maximum paths of permeability and the general permeability of the coal itself. Preferably the next step is to test the coal seam for its free water content. This can be done by placing a pump at the bottom of the seam and withdrawing water to the surface of the earth until the water table in the immediate vicinity of the well bore is lowered to the bottom of the seam. The well then is preferably shut in for a period of time, for example 12 hours, and then the drawdown is resumed by pumping out the accumulated water. These cycles are repeated until reliable data is obtained.

With the data derived from the cores and the water drawdown procedure, the production well pattern together with well spacing distances can be finalized. Wells aligned with the prevailing directions of maximum permeability will be relatively easy to link together through the coal using the technique of a reverse burn, with production accomplished generally with a forward burn to form an effective reaction zone. Wells aligned perpendicular to the prevailing directions of maximum permeability are more difficult to link together through the coal and it is preferable that linkage be postponed until parallel reaction zones are established along the prevailing directions of maximum permeability. Once these reaction zones are well established in a shrinking coal, free water is vaporized in the seam adjacent to the reaction zone, heat is added to the dried coal with resultant shrinkage of the coal and attendant opening of paths of permeability. Then wells located across formerly relatively tight portions of the coal may be linked using the reverse burn linkage technique followed by the forward burn procedure to establish a reaction zone generally perpendicular to the initial reaction zones.

Very rarely will a coal seam be perfectly flat in relation to the horizontal. Therefore in the usual case it is preferable to begin the production sequence on the down dip side of the property to be produced, and expand production in the general updip direction with respect to the coal. Migration of the free water in the coal can be expected to proceed generally in a down dip direction. Thus it is preferable to drill several complete patterns of wells prior to initiating production, with one complete pattern located updip from the initial production pattern and two patterns on strike, one on either side of the initial production pattern. In this arrangement the adjacent patterns prior to being placed on production can serve as water withdrawal wells, sometimes called water interceptor wells, to expand the scope of the localized area where the water table is lowered to facilitate in situ production. In some cases the number of wells required to effect water drawdown may be reduced to the row immediately updip from the immediate production pattern.

By placing wells that are used as water interceptor wells adjacent to the immediate production pattern of wells, drawdown of the water table within the production pattern is greatly simplified. In many cases it is possible to attain ignition of a production well with modest amounts of pre-ignition water drawdown, then sustaining combustion by injection of oxidizer at a pressure that excludes the further encroachment of water into the reaction zone.

Thus it may be seen that in situ production of coal may be undertaken in a wet coal seam by selecting the production well pattern based on patterns of permeability determined by oriented cores, that generally parallel reaction zones may be established along patterns of maximum permeability, that production wells may be readily linked and reaction zones established in coal whose permeability is enhanced by vaporizing the water content with resulting shrinkage of the coal, that encroachment water may be controlled by injection of oxidizer under suitable pressure, and that troublesome quantities of free water may be removed from the coal ahead of the production pattern advance. While the present invention has been described with a certain degree of particularity it is understood that the present disclosure has been made by way of example and that changes in details of structure may be made without departing from the spirit thereof.

What is claimed is:

1. In a wet coal seam underground wherein the prevailing directions of maximum paths of permeability have been established, a method of initiating production of the coal in situ comprising the steps of drilling a first pattern of production wells from the surface of the earth into the wet coal seam, the pattern of production wells being aligned along the prevailing directions of maximum paths of permeability in the coal, drilling a second pattern of production wells from the surface of the earth into the coal seam, the second pattern of production wells being adjacent to the first pattern of production wells, equipping each production well to permit injection of fluids into the coal seam and to withdraw fluids from the coal seam, with the resultant capability for each of the production wells to be utilized as an injection well or as a withdrawal well, withdrawing water from the coal seam through the said second pattern of production wells with the resultant lowering of the water table, linking the production wells of the first pattern through the coal seam, the said linking being accomplished along the maximum paths of permeability in the coal, then establishing a first reaction zone in the coal.

2. The method of claim 1 wherein the said pattern of production wells is a five spot pattern.

3. The method of claim 1 wherein pressure is established within the said reaction zone of sufficient magnitude to substantially exclude encroachment water.

4. The method of claim 1 further including the steps of establishing a second reaction zone in the coal, the second reaction zone being substantially parallel to the first reaction zone.

5. The method of claim 4 further including the steps of:

continuing the said two reaction zones until a substantial portion of the said coal within the said pattern of production wells is heated to a temperature wherein the free water content of the said coal is converted to vapor, then establishing a third reaction zone within the said coal, the said third reaction zone being substantially perpendicular to the said two reaction zones, and the said third reaction zone being between two wells in the said pattern of production wells.

6. A method of preparing an underground wet coal seam for production in situ comprising the steps of drilling evaulation wells into the coal seam, taking oriented cores in the coal seam, testing the coal seam for free water content, completing the wells so they are hermetically sealed, determining the prevailing directions of maximum paths of permeability in the coal, establishing a pattern of production wells into the said coal seam, the said pattern of production wells being composed of at least one said evaluation well, and the balance of the wells in the said pattern of production wells being wells that are drilled without taking oriented cores, positioning the location of the said pattern of production wells so that at least two wells of the said pattern are aligned along a prevailing direction of maximum path of permeability through the said coal, drilling water interceptor wells adjacent to the said pattern of production wells, the said water interceptor wells being located in consonance with an expanded pattern of production wells, and lowering the water table in the immediate vicinity of the said pattern of production wells by pumping water out of the said water interceptor wells.

7. The method of claim 6 further including the steps of linking the said two wells of the said pattern, the said linking being accomplished by a reverse burn through the said coal, then establishing production with a forward burn between the said two wells, the said production being established in a reaction zone in the said coal seam.

* * * * *